United States Patent [19]

Goud

[11] Patent Number: 4,938,497

[45] Date of Patent: Jul. 3, 1990

[54] SAFETY BINDING FOR A SKI

[75] Inventor: Gilles R. Goud, Annecy, France

[73] Assignee: Salomon S.A., Annecy Cedex, France

[21] Appl. No.: 297,314

[22] Filed: Jan. 17, 1989

[30] Foreign Application Priority Data

Jan. 15, 1988 [FR] France ..... 88 00432

[51] Int. Cl.[5] ..... A63C 9/085

[52] U.S. Cl. ..... 280/625; 280/626; 280/628; 280/629; 280/634

[58] Field of Search ..... 280/623, 625, 626, 628, 280/629, 634, 635

[56] References Cited

U.S. PATENT DOCUMENTS

| | | | |
|---|---|---|---|
| 4,067,594 | 1/1978 | Kikuchi | 280/625 |
| 4,336,956 | 6/1982 | Richert et al. | 280/625 |
| 4,436,321 | 3/1984 | Storandt et al. | 280/612 |
| 4,561,673 | 12/1985 | Pascal et al. | 280/629 |
| 4,685,696 | 8/1987 | Sedlmair et al. | 280/625 |
| 4,728,117 | 3/1988 | Stepanek | 280/629 |
| 4,735,434 | 4/1988 | Sedlmair | 280/625 |

FOREIGN PATENT DOCUMENTS

| | | |
|---|---|---|
| 200044 | 11/1986 | European Pat. Off. . |
| 3343943 | 6/1985 | Fed. Rep. of Germany . |
| 3539969 | 5/1987 | Fed. Rep. of Germany . |
| 8502551 | 6/1985 | World Int. Prop. O. . |

*Primary Examiner*—Charles A. Marmor

*Assistant Examiner*—Eric Culbreth

*Attorney, Agent, or Firm*—Sandler, Greenblum & Bernstein

[57] ABSTRACT

A binding for retaining an end of a boot upon a ski. The binding includes a body, a device for securing the body to the ski, and a retention jaw for engagement with the end of the boot in an engagement position. The retention jaw includes a first arm and a second arm mounted on the body on respective sides of the longitudinal axis of the binding for lateral movement with respect to the body, and a first wing and a second wing mounted for lateral movement, respectively, on the first arm and on the second arm. The first wing and the second wing have a closed position in which the first wing and the second wing are substantially fixed for movement with the first arm and the second arm, respectively. The binding further includes a mechanism for elastically biasing the jaw in the engagement position and the wings in the closed position. Further, a member is provided for connecting the first wing and the second wing together for lateral movement and a linking mechanism for the first wing and the second wing. The linking mechanism is functionally connected to the elastically biasing mechanism for permitting the first wing and the second wing to remain in the closed position and for permitting the first and the second wing to move to an open position upon the application of a release threshold force against one of the wings.

30 Claims, 3 Drawing Sheets

SAFETY BINDING FOR A SKI

BACKGROUND OF THE INVENTION

1. Field of the Invention

The present invention is directed to a safety binding for releasably retaining an end of a boot, particularly its front end, mounted on a ski.

2. Description of Background and Relevant Information

Front abutment safety bindings typically include a body mounted on a base which is affixed to the ski, wherein the body carries, at its rear portion, a retention jaw for the boot. The jaw includes two opposite lateral retention wings and an energization mechanism positioned within the body to elastically return the jaw to the engagement position. The energization mechanism includes a compressed energy spring supported at one end on a support surface connected to the body and, at its other end, on a force transmission element which is longitudinally movable within the body and is coupled to the jaw in a manner so as to elastically bias the jaw against the front of the boot, to ensure the retention thereof on the ski.

Among the presently known front abutment bindings are those which are described in German Pat. Nos. 35 39 969 and 33 43 943, which include a jaw having two lateral retention wings connected by a transverse member, the two wings being respectively journalled around two vertical axes on the rear portions of substantially longitudinal arms and which are themselves journalled, at their front ends, around two vertical axes. The two front journal axes of the two arms of the base of the front abutment binding, and the two rear movable axes connecting the jaw to the two arms constitute the four apices of a deformable isosceles trapezoid of which one base is defined by the two front fixed axes, and the other base by the two rear movable axes. The two lateral retention wings for the boot are normally maintained latched in the engagement position and they are unlatched, in the case of a lateral bias exceeding a predetermined value constituting the release threshold of the front abutment binding, after a predetermined deformation of the isosceles trapezoid. The wings are maintained in the engagement position by the energization mechanism of the binding.

Such a binding in which the jaw is displaced laterally in one direction or the other, as a single piece, until a position is reached in which the unlatching of the wings occurs, offers the advantage of reducing the frictional forces between the jaw and the boot, since the jaw accompanies the lateral movement of the boot. However, such a binding has disadvantages, namely, that the extent of lateral elastic movement of the jaw is reduced; that the energization mechanism of the jaw is independent of the unlatching mechanism of the wings, which results in a substantial number of elements; and that such a binding does not allow for a precise adjustment in height for adapting the jaw to boots having different sole thicknesses.

SUMMARY OF THE INVENTION

The present invention is intended to overcome the disadvantages noted above by providing a safety binding for a ski adapted to maintain, in a releasable manner, the front of a boot mounted on the ski. The binding includes a body mounted on a base affixed to the ski carrying, in a rear portion, a retention jaw for the boot which includes two opposed lateral retention wings connected by a transverse member. The two wings are respectively journalled at two substantially vertical movable axes, on rear portions of substantially longitudinal arms. The arms are journalled, at their front ends, around two substantially vertical axes, so that the two front journal axes of the two arms on the base of the binding and the two rear movable axes connecting the jaw to the two arms constitute the four apices of a deformable isosceles trapezoid of which one base is defined by the two front fixed axes and the other base by the two movable rear axes. The binding further includes an energization mechanism positioned within the body to elastically return the jaw to the engagement position, and an energy spring supported, at one end, on a support surface linked to the body and, at its other end, on a force transmission element which is longitudinally movable in the body. The energization mechanism is coupled to the jaw in a manner so as to elastically bias the jaw against the front of the boot to ensure the retention thereof on the ski. Each lateral retention wing includes a front arm which is journalled, around a substantially vertical axis, on one end of a transversely extending linkage half-lever. The two linkage half-levers are journalled on one another, at their internal end portions which are positioned substantially in the longitudinal plane of symmetry of the binding, around a substantially vertical common axis. The two substantially vertical journal axes of the linkage half-levers on the front arms of the wings define, respectively, the two apices of the minor base of a second deformable isosceles trapezoid whose major base is defined by the two journal axes of the wings on the arms. The energization mechanism includes a pressure element exerting a force towards the rear in the longitudinal plane of symmetry of the binding, the force being applied substantially axially on the common journal axis of the internal end portions of the two linkage half-levers.

According to a further aspect of the invention, the common, substantially vertical journal axis of the internal end portions of the two linkage half-levers is situated slightly in front of the two journal axes of the half-levers on the wings so that the axes define an obtuse angle of approximately 180°, open towards the rear.

According to a further aspect of the invention, the piston carries, at a rear end portion, a roller mounted on a substantially vertical axis positioned in the longitudinal plane of symmetry of the binding, the roller being pushed, in the engagement position, against the internal end portions of the front edges, forming respective lateral energization ramps, of the two linkage half-levers so that a force is directed axially towards the substantially vertical journal axis which is then positioned in the longitudinal plane of symmetry.

According to a still further aspect of the invention, in the engagement position, the two ramps are connected to one another, in a substantially continuous manner, at the longitudinal axis.

Further according to the invention, the substantially vertical journal axis of the two linkage half-levers is supported against a cradle which is affixed to a front surface of the linkage transverse member. The cradle is constituted by an element in the form of a V open towards the front and positioned in a central portion of the linkage transverse member.

Still further according to the invention, a central block is positioned under the transverse member connecting the wings and which includes a projection extending towards the front at its lower portion. The projection extends under a ramp in the shape of V which is formed in a transverse projection of the base. The block is connected to the transverse member by means of a substantially vertical screw which is adjustable in height and whose upper portion includes a head which is connected to the transverse member and which is screwed, through a lower threaded portion, in a substantially vertical tapped hole provided in a central portion of the block, the screw extending through a central hole provided in the transverse linkage member.

According to a still further aspect of the invention, the ramp includes a central horizontal flattened portion and, on each side of the substantially vertical and longitudinal plane of symmetry, a half-ramp is inclined from bottom to top towards the exterior.

The binding according to the invention can be further defined as including a body; means for securing the body to the ski; a retention jaw for engagement with the end of the boot in an engagement position, the retention jaw including a first arm and a second arm; the first arm and the second arm being mounted on the body on respective sides of the longitudinal axis for lateral movement with respect to the body; a first wing and a second wing; the first wing and the second wing being mounted for lateral movement, respectively, on the first arm and on the second arm, the first wing and the second wing having a closed position in which the first wing and the second wing are substantially fixed for movement with the first arm and the second arm, respectively; means for elastically biasing the jaw in the engagement position and the wings in the closed position; means for connecting the first wing and the second wing together for lateral movement; and means for linking the first wing and the second wing, the linking means further being functionally connected to the elastically biasing means for permitting the first wing and the second wing to remain in the closed position and for permitting the first wing and the second wing to move to an open position upon the application of a release threshold force against one of the first wing and the second wing.

According to a further aspect of the invention, the binding includes a transverse member pivotally connected to the first wing at a first pivot axis and pivotally connected to the second wing at a second pivot axis.

According to a further aspect of the invention, the binding includes a transversely extending linkage pivotally connected to the first wing at a third pivot axis and pivotally connected to the second wing at a fourth pivot axis.

According to a still further aspect of the invention, the means for mounting the first arm and the second arm on the body include a fifth pivot axis and a sixth pivot axis, respectively.

Still further according to the invention, the first, second, third, and fourth pivot axes form the apices of a first substantially isosceles trapezoid and the third, fourth, fifth, and sixth pivot axes form the apices of a second substantially isosceles trapezoid, wherein the means for connecting and the means for linking are configured and arranged such that the first substantially isosceles trapezoid remains substantially dimensionally unchanged during lateral movement of the wings while the wings are in the closed position.

The transversely extending linkage according to the invention includes a first linkage member pivotally connected about the third pivot axis, a second linkage member pivotally connected about the fourth pivot axis, and means for pivotally connecting the first linkage member and the second linkage member about a seventh pivot axis.

The means for pivotally connecting the first linkage member and the second linkage member, according to the invention, includes a pin mounted substantially along the longitudinal axis.

Further according to the invention, the first and second linkage members have front edge portions and the elastically biasing means includes a pressure element for exerting a force against the front edge portions of the first and second linkage members.

Still further according to the invention, the first and third pivot axes define a first plane and the second and fourth pivot axes define a second plane, wherein the open position of the first wing and the second wing is determined by the configuration of the binding by which either of the first plane and the second plane is moved laterally inwardly with respect to the ski substantially beyond a point at which the pressure element exerts the force against a front edge portion of the first or second linkage member.

Still further according to the invention, the third pivot axis, the fourth pivot axis and the seventh pivot axis define an obtuse angle by which the seventh pivot axis is located substantially along the longitudinal axis. The obtuse angle is open in the direction toward which the boot is to be engaged by the binding.

Still further according to the invention, the pressure element includes a roller mounted for rotation around an axis extending substantially along the longitudinal axis in rolling engagement with the front edge portions of the first and second linkage members. In the engagement position of the binding, the pin is forced in a direction to be functionally supported against the transverse member by the pressure element.

Further, a receiving member is connected to the transverse member for receiving the pin in the engagement position of the binding. The receiving member is configured to retain the pin laterally in the engagement position of the binding.

Still further according to the invention, a pusher movably mounted with respect to the body which is functionally engaged with the means for elastically biasing the jaw, and a pedal is movably mounted for functional engagement with the pusher wherein, in response to a force directed upon the pedal, the pusher directs a force to the means for elastically biasing the jaw in opposition to a force exerted by the means for elastically biasing the jaw.

Still further according to the invention, a member is positioned beneath the connecting means and is connected thereto by a height-adjusting screw for the body and jaw of the binding. A projection extends generally longitudinally from the member, and a ramp member is provided beneath which the projection extends. The ramp member includes a generally flattened portion along the longitudinal axis which is engaged by the projection in the engagement position of the binding, and includes laterally and upwardly extending surfaces on either side of the flattened portion for sliding engagement with the projection.

BRIEF DESCRIPTION OF THE DRAWINGS

The invention will now be described with reference to certain non-limiting examples of various embodiments of the present invention in which.

DESCRIPTION OF PREFERRED EMBODIMENTS

The binding of the present invention includes a front binding having a substantial extent of lateral elasticity of the jaw and allows for a very easy adjustment of the height of the jaw.

To this end, the safety binding of the present invention includes a body mounted on a base adapted to be affixed to the ski. The body carries, at its rear portion, a retention jaw for the boot which includes two laterally opposed retention wings connected by a transverse member, the two wings being respectively journalled around two substantially vertical axes, on rear portions of substantially longitudinal arms. These arms are themselves journalled, at their front ends, around two substantially vertical axes. The two front journal axes of the two arms on the base of the binding and the two rear movable axes connecting the jaw to the two arms constitute the four apices of a deformable isosceles trapezoid. One base of the trapezoid is defined by the two front fixed axes and the other base by the two rear movable axes. An energization mechanism is positioned within the body to elastically return the jaw to the engagement position. The energization mechanism includes an energy spring supported, at one end, on a support surface connected to the body and, at its other end, on a force transmission element which is longitudinally movable within the body and coupled to the jaw in a manner so as to elastically bias the jaw against the front of the boot, to ensure the retention thereof on the ski.

The binding is characterized in that each lateral retention wing includes a front arm which is journalled, around a substantially vertical axis, on one end of a transversely extending linkage half-lever. The two linkage half-levers are journalled on one another at their internal ends which are positioned in the longitudinal plane of symmetry of the binding, around a common substantially vertical axis. The two substantially vertical journal axes of the linkage half-levers on the front arms of the wings define, respectively, the two apices of the minor base of a second deformable isosceles trapezoid whose major base is defined by the two journal axes of the wings on the arm. The energization mechanism includes a pressure element which exerts a force towards the rear in the longitudinal plane of symmetry of the binding, this force being applied axially on the common substantially vertical journal axis of the internal portions of the two linkage half-levers.

Figure 1:
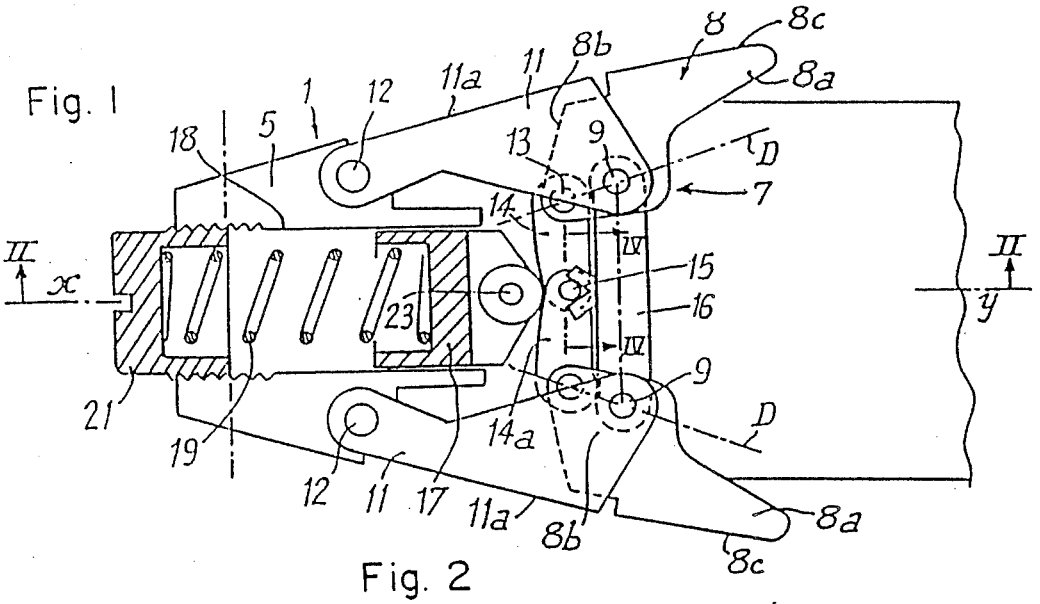
FIG. 1 is a horizontal cross-sectional view of a front abutment binding according to the invention in the engagement position.
Figure 2:
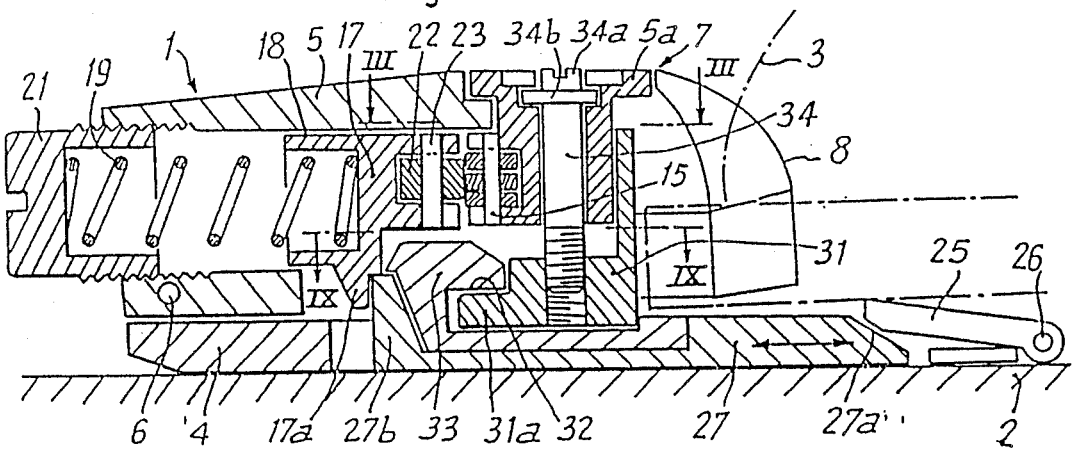
FIG. 2 is a vertical and longitudinal cross-sectional view along line II—II of FIG. 1.
Figure 3:
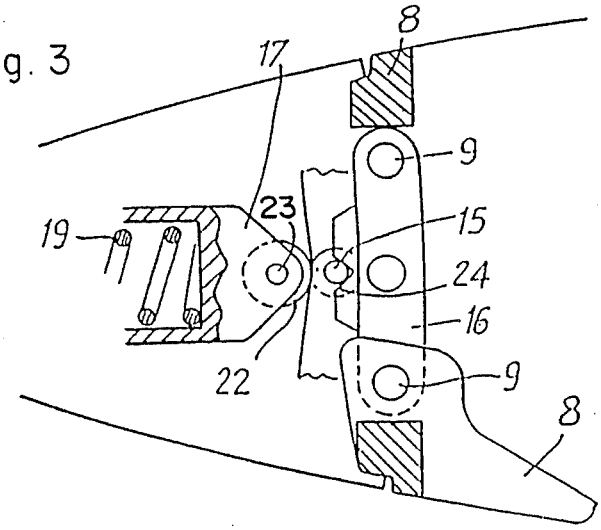
FIG. 3 is a partially broken-away horizontal cross-sectional view along line III—III of FIG. 2.

Referring now to FIGS. 1–3, a safety binding 1 is illustrated being mounted on a ski 2 and being adapted to retain the front end of a ski boot 3 shown in dashed lines on a ski. This safety binding, or "front abutment", includes a base 4 affixed to the ski and on which a body 5 is mounted which can pivot on the base, at its front portion, around a lower substantially horizontal and transverse axis 6. The body 5 includes, at its rear portion, a retention jaw 7 including two lateral retention wings 8.

Figure 4:
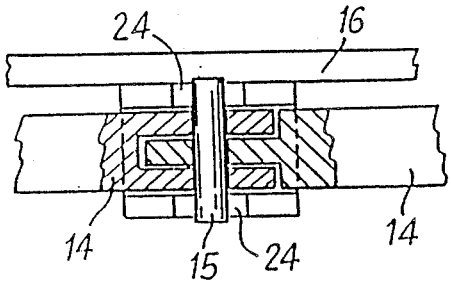
FIG. 4 is a vertical and transverse partial cross-sectional view along line IV—IV of FIG. 1.

Each wing 8 is journalled, around a substantially vertical axis 9 on the rear portion of an arm 11 extending from the body and which is itself journalled, at its front portion, on body 5, around a substantially vertical axis 12. Each journalled wing 8 includes a rear arm **8*a* forming a lateral and substantially vertical retention element for the sole of the boot 3. The rear arm 8*a* is angled from the interior towards the exterior and from the front towards the rear. Each lateral retention wing 8 likewise includes a front arm 8*b* which is journalled around a substantially vertical axis 13 on one end of a transversely extending linkage half-lever 14. The two linkage half-levers 14 which are respectively connected to the two wings 8 by the journal axes 13 are journalled on one another at their internal ends which are positioned in the longitudinal plane of symmetry xy of the binding around a common substantially vertical axis 15 along which a journalling pin extends. To this end, the end portion of one of the levers 14 has the shape of a cap (FIG. 4) while that of the other lever 14 forms a small tongue engaged between the two wings of the cap. Each linkage half-lever 14 has a front edge 14*a* which constitutes a lateral energization ramp. In the engagement position (FIG. 1) the two ramps 14*a*** are connected to one another, in a substantially continuous manner, on the longitudinal axis xy.

The common journal axis 15 of the internal portions of the two linkage half-levers 14 is positioned slightly in front of the two journal axes 13 of the half-levers 14 on the wings 8 and the three axes 13, 15, 13 define an obtuse angle which is close to 180° and which is open towards the rear. The two substantially vertical axes 9 of the two wings 8 are likewise connected to one another by an upper rigid linkage transverse member 16, shown in perspective in FIG. 5.

The mechanism previously described substantially defines, by consequence, two journalled isosceles trapezoids overlapped within one another, and which have a common base whose apices are defined by the two journal axes 9 and 12 of the wings 8 on the arms 11. The apices of the major base of the first journalled trapezoid, having the larger dimension, are constituted by the two journal axes 12 of the two arms 11 on body 5. The apices of the minor base of the second journalled trapezoid, having a smaller dimension than the preceding, are defined by the journal axes 13 between the two wings 8 and the two linkage half-levers 14.

Figure 5:
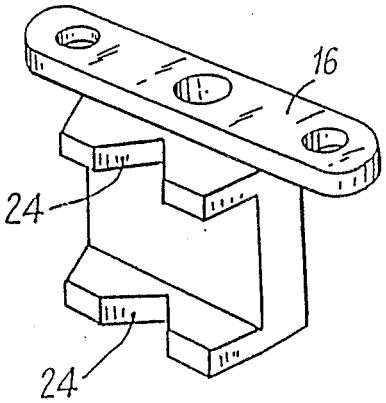
FIG. 5 is a perspective view of the transverse member of the binding.

The energization mechanism of the binding according to the invention includes a piston 17 slidably longitudinally positioned in an axial bore 18 provided in the front portion of body 5. Piston 17 is pushed towards the rear by a compression spring 19. This spring is supported, at its rear end, on piston 17 and, at its front end, on cap 21 which projects towards the front of body 5 and which is screwed in the front tapped portion of bore 18. Cap 21 permits, in a normal manner, the adjustment of the stiffness of the binding, by virtue of the extent to which it is screwed into bore 18, causing a compression, which is more or less substantial, of compression spring 19. Piston 17 carries, at its rear end, a roller 22 mounted on a substantially vertical axis 23 positioned in the longitudinal plane of symmetry xy of the binding. Roller 22 is thus pushed, in the engagement position of the binding, against the front edges 14*a*, which act as ramps, of the two linkage half-levers 14, symmetrically with respect to the axis xy, so that its force is axially directed towards the journal axis 15 which is positioned substantially in the longitudinal plane of symmetry xy. In this engagement position, the substantially vertical journal axis 15 of the internal portions of the two linkage half-lever 14 is supported, at its upper and lower ends, against a cradle 24, as shown in FIGS. 3 and 5, e.g., which is affixed to the front surface of the transverse linkage member 16. This cradle is preferably constituted by two upper and lower elements in the form of a V open towards the front and positioned in the central portion of the front surface of the transverse linkage member 16.

The binding according to the invention is shown in the engagement position in FIGS. 1–7. In this position roller 22 carried by piston 17 which is pushed towards the rear by compression spring 19, is supported against the internal portions of the front edges of the two linkage half-levers 14 which form ramps 14*a*. As a result, the pin located at journal axis 15 of the two linkage half-levers 14 is pushed against the support cradle 24 of transverse member 16, in which it is maintained in a locked position. The cradle 24 serves to retain axis 15 until the moment of release of the binding. In the engagement position the wings 8 are thus maintained in the position shown in FIG. 1 in which the external edges 8*c* are substantially coplanar with the external edges 11*a* of the arms 11.

In the case of a purely lateral bias resulting from a torsion of the leg of the skier, the boot tends to push a wing 8 towards the exterior. Under the effect of this bias, the entire jaw 7 is displaced towards the exterior, in the direction of the bias, the two arms 11 pivoting simultaneously around their axes 12 and the two wings 8 accompanying this movement by remaining affixed to the arms 11, while forming relatively rigid assemblies with these arms. Otherwise stated, the large journalled trapezoid, defined by the axes 9 and 12, is deformed while maintaining a trapezoidal shape, its minor base defined by the journal axes 9 being displaced transversely in the direction of bias. The other journalled trapezoid of smaller dimension, defined by the axes 9 and 13, is displaced transversely in translation, without being deformed. As a result, during this displacement, the common journal axis 15 of the two half-levers 14 remains supported in its cradle 24 carried by the transverse linkage member 16. The two linkage half-levers 14 are displaced simultaneously in the transverse direction, while remaining transversely aligned, so that the roller 22 of the energization mechanism, rolling on the front edge forming a ramp 14*a* of the linkage half-lever 14 displaced transversely against it, is pushed towards the rear, simultaneously with the piston 17, and that the compression spring 19 is further compressed.

Figure 8:
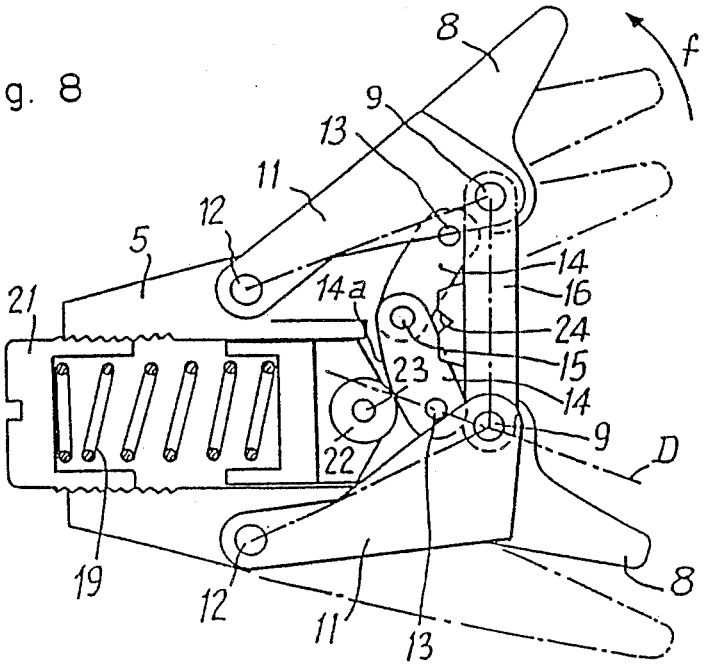
FIG. 8 is a horizontal cross-sectional view similar to that of FIG. 1, of the front abutment in the release position as a result of a lateral force.

The unlatching of wing 8 occurs approximately (FIG. 8) at the moment when axis 23 of roller 22 crosses the straight line D, or vertical plane, passing through the axes 9 and 13, upon the biasing of the wing toward the exterior of the ski. In fact this unlatching occurs slightly before, taking into account that the axis 15 is slightly ahead of the transverse plane defined by the two axes 13 and that the lateral bias of the wing 8 tends to naturally open the elbow joint formed by the two journalled linkage half-levers 14. At the moment the threshold of the release is achieved, the roller 22 pivots against the front of the linkage half-lever 14, with the ramp 14*a* with which it is in contact, in a manner so as to "break" the elbow joint, and the biased wing 8 can then pivot towards the exterior along the arrow f as is shown in FIG. 8, which allows for the release of the boot.

The binding according to the invention can also include a mechanism causing a reduction in the stiffness of the binding with respect to a lateral bias, in the case of a simultaneous forward fall of the skier. This mechanism includes a pedal 25 positioned under the front of the sole of the boot, forming a forward fall sensor. The pedal 25 is journalled around a substantially horizontal and transverse axis 26 and is supported, at its front portion, on a ramp 27*a*, which is inclined from bottom to top and rear to front, which is provided at the rear portion with a pusher 27 for a forward fall. Pusher 27 is slidably longitudinally mounted in base 4 and it includes, at its front end, an arm 27*b* extending substantially vertically upwardly, and which is supported against the rear surface of a lower projection 17*a* of piston 17.

Consequently, in the case of a forward fall, the pedal 25 which is pushed towards the ski by the sole of the boot, causes a sliding of pusher 27 towards the front and, consequently, pusher 27 pushes piston 17 towards the front, which results in an additional compression of the energy spring 19 and a corresponding reduction in the amount of further compression required for a lateral release, i.e., in the case where the leg of the skier is additionally biased in torsion.

Figure 6:
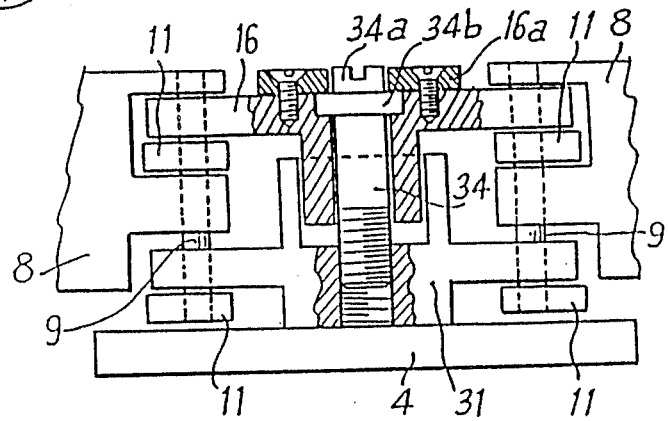
FIG. 6 is a rear view of the binding.
Figure 7:
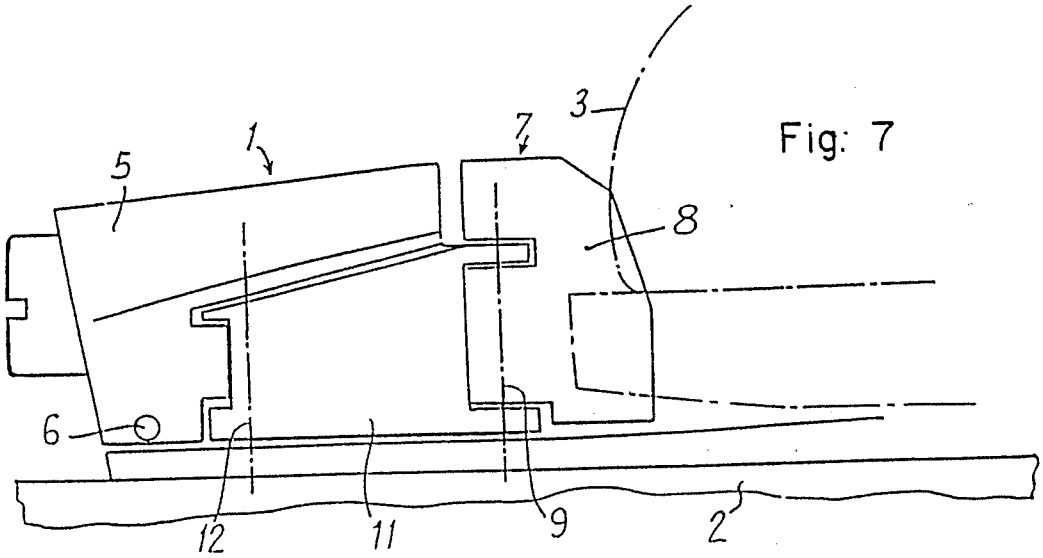
FIG. 7 is a side elevational view of the front abutment in the engagement position.
Figure 9:
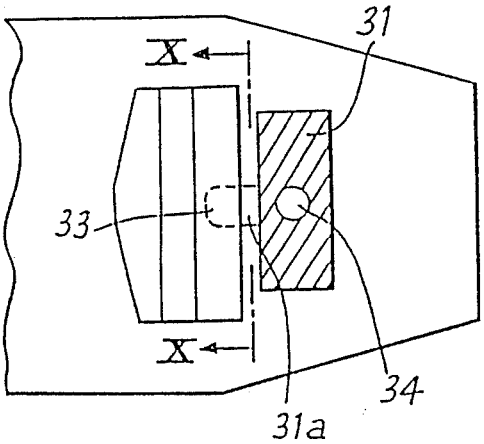
FIG. 9 is a horizontal cross-sectional view along line IX—IX of FIG. 2.
Figure 10:
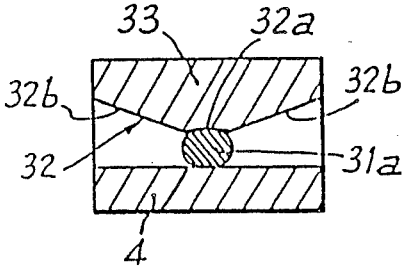
FIG. 10 is a vertical and transverse cross-sectional view along line X—X of FIG. 9.

The binding according to the invention likewise includes means for exerting an influence on the energization mechanism during a rearward fall of the skier. These means include a central block 31 positioned under transverse member 16 connecting the wings 8 and which include a projection 31*a* extending towards the front at its lower portion, as shown in FIGS. 2, 9, and 10. Projection 31*a* extends under a ramp 32, generally in the shape of a V, which is formed in a transverse projection 33 of base 4, a projection which is situated beneath the rear portion of piston 17. The ramp 32 includes a central horizontal flattened portion 32*a* and, on each side of the vertical and longitudinal plane of symmetry xy, a half-ramp 32*b* which is inclined from bottom to top towards the exterior. Furthermore, the block 31 is connected to the upper transverse member 16 by means of a substantially vertical screw or equivalent threaded fastener 34 and which is adjustable in height and whose upper portion which includes the head 34*a* is connected to the transverse member 16 and which is screwed, through its lower threaded portion, in a substantially vertical tapped hole provided in the central portion of block 31. Screw 34 extends through a substantially vertical central hole provided in the transverse linkage member 16 and its head 34a is accessible from the top of the binding. Beneath this head 34a, screw 34 includes a small collar 34b which is immobilized, as shown in FIG. 6, by a small plate 16a affixed by screws on transverse member 16, in an opening provided in the upper portion of the transverse member 16.

Consequently, in the case of a purely rearward fall the front end of the sole of the boot tends to be lifted, but this movement is prevented by virtue of the fact that the front projection 31a is retained by the flattened portion 32a of the ramp 32. However, when the rearward fall is accompanied by a lateral bias the projection 31a of block 31 leaves the flattened portion 32a and slides laterally and upwardly along an inclined half-ramp 32b which produces a component of horizontal force directed towards the exterior, a component which adds to the lateral bias. Otherwise stated, here again the force exerted towards the top on the jaw 7, as a result of a rearward fall, causes a lessening of the release threshold of the binding with respect to a lateral bias, when the rearward fall of the skier is combined with a torsion of the leg.

The adjustment in height of the jaw 7, to allow for the binding to be adapted to different thicknesses of soles, occurs by means of the turning of screw 34 which is threadedly engaged in the block 31. Block 31, which is extended towards the front by the projection 31a, is maintained blocked in a substantially vertical position by virtue of the fact that it rests towards the bottom on the upper surface of base 4 and that its projection 31a is retained towards the top by the flattened portion 32a of the ramp 32. Consequently, the screwing or unscrewing of the screw 34, Whose head is connected to the transverse member 16 by the flange 34b, causes a displacement in height of the body assembly 5, of the jaw 7 and of the energization mechanism, by rotation around the front and lower journal axis.

Although the invention has been described with reference to particular means, materials and embodiments, it is to be understood that the invention is not limited to the particulars disclosed and extends to all equivalents within the scope of the claims.

What is claimed is:

1. A safety binding for a ski adapted to maintain, in a releasable manner, the front of a boot mounted on the ski, comprising a body mounted on a base affixed to the ski, said body carrying, in a rear portion, a retention jaw for the boot which comprises two opposed lateral retention wings connected by a transverse member, said two wings being respectively journalled at two substantially vertical movable axes, on rear portions of substantially longitudinal arms, said arms being journalled, at front ends thereof, around two substantially vertical axes, so that said two front journal axes of said two arms on said base of said binding and said two rear movable axes connecting said jaw to said two arms constitute the four apices of a deformable, substantially isosceles trapezoid of which one base is defined by said two front fixed axes and the other base by said two movable rear axes, and an energization mechanism positioned within said body to elastically return said jaw to an engagement position from a release position, said energization mechanism comprising an energy spring supported, at one end, on a support surface linked to said body and, at its other end, on a force transmission element which is longitudinally movable in said body and coupled to said jaw in a manner so as to elastically bias said jaw against the front of the boot, to ensure the retention thereof on the skit, a first linkage half-lever and a second linkage half-lever, wherein each said lateral retention wing comprises a front arm which is journalled, around a substantially vertical axis, on one end of a respective linkage half-lever extending transversely, said first and second linkage half-levers being journalled on one another, at their internal end portions which are positioned substantially in the longitudinal plane of symmetry of said binding, around a substantially vertical common axis, said two substantially vertical journal axes of said linkage half-levers on said front arms of said wings defining, respectively, the two apices of the minor base of a second deformable isosceles trapezoid whose major base is defined by the two journal axes of said wings on said arms, each said first and second linkage half-levers including energization ramps along respective front edges thereof, wherein said energization mechanism comprises a pressure element exerting a force towards the rear in the longitudinal plane of symmetry of said binding, said force being applied substantially axially on said common journal axis of said internal end portions of said first and second linkage half-levers, and wherein said pressure element moves along and exerts a force against said energization ramps when said jaw moves towards the release position.

2. Safety binding for a ski according to claim 1 wherein said common, substantially vertical journal axis of said internal end portions of said first and second linkage half-levers is situated slightly in front of said two journal axes of said half-levers on said wings so that said axes define an obtuse angle of approximately 180° open towards the rear.

3. Safety binding for a ski according to claim 2 wherein said force transmission element includes a piston, said piston carries, at a rear end portion, a roller mounted on a substantially vertical axis positioned in the longitudinal plane of symmetry of said binding, said roller being pushed, in the engagement position, against said internal end portions of said linkage half-levers so that a force is directed axially towards said substantially vertical journal axis which is then positioned in said longitudinal plane of symmetry.

4. Safety binding for a ski according to claim 3 wherein in the engagement position, said two ramps are connected to one another, in a substantially continuous manner, at said longitudinal axis.

5. Safety binding for a ski according to claim 2 wherein said substantially vertical journal axis of said first and second linkage half-levers on one another is supported against a cradle which is affixed to a front surface of said linkage transverse member.

6. Safety binding for a ski according to claim 5 wherein said cradle is constituted by an element in the form of a V open towards the front and positioned in a central portion of said linkage transverse member.

7. Safety binding for a ski according to claim 1 further comprising a ramp on said body, a central block positioned under said transverse member connecting said wings and which comprises a projection extending towards the front at its lower portion, said projection extending under said ramp generally in the shape of a V, which is formed in a transverse projection of said base, said block being connected to said transverse member by means of a substantially vertical screw which is adjustable in height and whose upper portion comprises a head which is connected to said transverse member and which is screwed, through a lower threaded portion, in a substantially vertical tapped hole provided in a central portion of said block, said screw extending through a central hole provided in said transverse linkage member.

8. Safety binding for a ski according to claim 7 wherein said ramp comprises a central horizontal flattened portion and, on each side of said substantially vertical and longitudinal plane of symmetry, a half-ramp which is inclined from bottom to top towards the exterior.

9. A binding for retaining an end of a boot upon a ski, said binding having a longitudinal axis and further comprising:

(a) a body;
(b) means for securing said body to said ski;
(c) a retention jaw for engagement with said end of said boot in an engagement position, said retention jaw comprising:
  (i) a first arm and a second arm;
  (ii) first means for mounting said first arm and said second arm on said body on respective sides of said longitudinal axis for lateral movement with respect to said body;
  (iii) a first wing and a second wing; and
  (iv) second means for mounting said first wing and said second wing for lateral movement, respectively, on said first arm and on said second arm, said first wing and said second wing having a closed position in which said first wing and said second wing are substantially fixed for movement with said first arm and said second arm, respectively;
(d) means for elastically biasing said jaw in said engagement position and said wings in said closed position;
(e) means for connecting said first wing and said second wing together for lateral movement; and
(f) means for linking said first wing and said second wing, said linking means further cooperating with said elastically biasing means for permitting said first wing and said second wing to remain in said closed position and for permitting said first wing and said second wing to move to an open position upon the application of a release threshold force against one of said first wing and said second wing, said means for linking including a first linkage member and a second linkage member having respective front edge portions, said first and second linkage member being connected together at respective internal end portions, said elastically biasing means exerting pressure substantially at the internal end portion when the binding is in the engagement position, and said elastically biasing means moving along and exerting pressure against one of said front edge portions to permit one of said wings to move to said open position.

10. The binding of claim 9 wherein said means for connecting comprises a transverse member pivotally connected to said first wing at a first pivot axis and pivotally connected to said second wing at a second pivot axis.

11. The binding of claim 10 wherein said first and second linkage members are respectively pivotally connected to said first wing at a third pivot axis and pivotally connected to said second wing at a fourth pivot axis.

12. The binding of claim 11 wherein said means for mounting said first arm and said second arm on said body comprises a fifth pivot axis and a sixth pivot axis, respectively.

13. The binding of claim 12 wherein said first, second, third, and fourth pivot axes form the apices of a first substantially isosceles trapezoid and said third, fourth, fifth, and sixth pivot axes form the apices of a second substantially isosceles trapezoid, wherein said means for connecting said means for linking are configured and arranged such that said first substantially isosceles trapezoid remains substantially dimensionally unchanged during lateral movement of said wings while said wings are in said closed position.

14. The binding of claim 11 comprising means for pivotally connecting said first linkage member and said second linkage member at said internal end portion about a seventh pivot axis.

15. The binding of claim 14 wherein said means for pivotally connecting said first linkage member and said second linkage member comprises a pin mounted substantially along said longitudinal axis.

16. The binding of claim 15 wherein said elastically biasing means comprises a pressure element for exerting a force against said front edge portions of said first and second linkage members.

17. The binding of claim 16 wherein said first and third pivot axes define a first plane and said second and fourth pivot axes define a second plane, wherein said open position of said first wing and said second wing is determined by the configuration of said binding in which either of said first plane and said second plane is moved laterally inwardly with respect to said ski substantially beyond a point at which said pressure element exerts said force against a front edge portion of said first or second linkage member.

18. The binding of claim 16 wherein said pressure element comprises a roller mounted for rotation around an axis extending substantially along said longitudinal axis, wherein said roller is in rolling engagement with said front edge portions of said first and second linkage members.

19. The linkage of claim 16 wherein in said engagement position of said binding, said pin is forced in a direction to be supported against said transverse member by said pressure element.

20. The binding of claim 19 further comprising a receiving member connected to said transverse member for receiving said pin in said engagement position of said binding.

21. The binding of claim 20 wherein said receiving member is configured to retain said pin laterally in said engagement position of said binding.

22. The binding of claim 14 wherein said third pivot axis, said fourth pivot axis and said seventh pivot axis define an obtuse angle by which said seventh pivot axis is located substantially along said longitudinal axis.

23. The binding of claim 22 wherein said obtuse angle is open in the direction toward which said boot is to be engaged by said binding.

24. The binding of claim 9 further comprising a pusher movably mounted with respect to said body for engagement with said means for elastically biasing said jaw, and a pedal movably mounted for engagement with said pusher wherein in response to a force directed upon said pedal, said pusher directs a force to said means for elastically biasing said jaw in opposition to a force exerted by said means for elastically biasing said jaw.

25. The binding of claim 9 further comprising a member positioned beneath said connecting means and connected thereto by a height-adjusting screw for said body and jaw of said binding, a projection extending generally longitudinally from said member, and a ramp member beneath which said projection extends.

26. The binding of claim 25 wherein said ramp member comprises a generally flattened portion along said longitudinal axis which is engaged by said projection in said engagement position of said binding, and laterally and upwardly extending surfaces on either side of said flattened portion for sliding engagement with said projection.

27. A safety binding for a ski adapted to maintain, in a releasable manner, the front of a boot mounted on the ski, comprising a body mounted on a base affixed to the ski, said body carrying, in a rear portion, a retention jaw for the boot which comprises two opposed lateral retention wings connected by a transverse member, said two wings being respectively journalled at two substantially vertical movable axes, on rear portions of substantially longitudinal arms, said arms being journalled, at front ends thereof, around two substantially vertical axes, so that said two front journal axes of said two arms on said base of said binding and said two rear movable axes connecting said jaw to said two arms constitute the four apices of a deformable, substantially isosceles trapezoid of which one base is defined by said two front fixed axes and the other base by said two movable rear axes, and an energization mechanism positioned within said body to elastically return said jaw to an engagement position from a release position, said energization mechanism comprising an energy spring supported, at one end, on a support surface linked to said body and, at its other end, on a force transmission element which is longitudinally movable in said body and coupled to said jaw in a manner so as to elastically bias said jaw against the front of the boot, to ensure the retention thereof on the ski, a first and second linkage half-lever wherein each said lateral retention wing comprises a front arm which is journalled, around a substantially vertical axis, on one end of a respective linkage half-lever extending transversely, said first and second linkage half-levers being journalled on one another, at their internal end portions which are positioned substantially in the longitudinal plane of symmetry of said binding, around a substantially vertical common axis, said two substantially vertical journal axes of said linkage half-levers on said front arms of said wings defining, respectively, the two apices of the minor base of a second deformable isosceles trapezoid whose major base is defined by the two journal axes of said wings on said arms, wherein said energization mechanism comprises a pressure element exerting a force towards the rear in the longitudinal plane of symmetry of said binding, said force being applied substantially axially on said common journal axis of said internal end portions of said first and second linkage half-levers, and further comprising a ramp on said body, a central block positioned under said transverse member connecting said wings and which comprise a projection extending towards the front at its lower portion, said projection extending under said ramp generally in the shape of a V, which is formed in a transverse projection of said body, said block being connected to said transverse member by means of a substantially vertical screw which is adjustable in height and whose upper portion comprises a head which is connected to said transverse member and which is screwed, through a lower threaded portion, in a substantially vertical tapped hole provided in a central portion of said block, said screw extending through a central hole provided in said transverse linkage member.

28. Safety binding for a ski according to claim 27 wherein said ramp comprises a central horizontal flattened portion and, on each side of said substantially vertical and longitudinal plane of symmetry, a half-ramp which is inclined from bottom to top towards the exterior.

29. A binding for retaining an end of a boot upon a ski, said binding having a longitudinal axis and further comprising:

(a) a body;
(b) means for securing said body to said ski;
(c) a retention jaw for engagement with said end of said boot in an engagement position, said retention jaw comprising:
  (i) a first arm and a second arm;
  (ii) first means for mounting said first arm and said second arm on said body on respective sides of said longitudinal axis for lateral movement with respect to said body;
  (iii) a first wing and a second wing; and
(iv) second means for mounting said first wing and said second wing for lateral movement, respectively, on said first arm and on said second arm, said first wing and said second wing having a closed position in which said first wing and said second wing are substantially fixed for movement with said first arm and said second arm, respectively;
(d) means for elastically biasing said jaw in said engagement position and said wings in said closed position;
(e) means for connecting said first wing and said second wing together for lateral movement;
(f) means for linking said first wing and said second wing, said linking means further cooperating with said elastically biasing means for permitting said first wing and said second wing to remain in said closed position and for permitting said first wing and said second wing to move to an open position upon the application of a release threshold force against one of said first wing and said second wing; and
(g) a member positioned beneath said connecting means and connected thereto by a height-adjusting screw for said body and jaw of said binding, a projection extending generally longitudinally from said member, and a ramp member beneath which said projection extends.

30. The binding of claim 29 wherein said ramp member comprises a generally flattened portion along said longitudinal axis which is engaged by said projection in said engagement position of said binding, and laterally and upwardly extending surfaces on either side of said flattened portion for sliding engagement with said projection.

* * * * *